United States Patent [19]

Musillo

[11] 4,372,131

[45] Feb. 8, 1983

[54] EARRING WITH LATCH MEMBER

[76] Inventor: Robert Musillo, 5481 Wolf Dr., Pittsburgh, Pa. 15236

[21] Appl. No.: 284,482

[22] Filed: Jul. 17, 1981

[51] Int. Cl.[3] ..... A44C 7/00

[52] U.S. Cl. ..... 63/12; 24/160; 24/241 S

[58] Field of Search ..... 63/12, 13; 24/160, 241 S, 24/241 SP, 241 SB, 233

[56] References Cited

U.S. PATENT DOCUMENTS

| | | | |
|---|---|---|---|
| 371,283 | 10/1887 | Smitten | 63/12 |
| 901,827 | 10/1908 | Pittman | 24/160 |
| 3,575,013 | 4/1971 | Chernow et al. | 63/12 |
| 4,114,399 | 9/1978 | Zur | 24/241 S |

*Primary Examiner*—F. Barry Shay
*Attorney, Agent, or Firm*—William J. Ruano

[57] ABSTRACT

An earring for pierced ears, which earring is less than 360° and the opening bridged by a pivotal post which pierces the ear and at the end of which is latched onto a latchplate which is spring-biased towards the post pivot. The free end of the post is guided by a depression or groove formed in the latchplate until it reaches a hole through which said post will extend so as to lock the earring firmly on the wearer's ear. Various forms of latchplate are illustrated, as well as the spring means for biasing the latchplate. One form involves shaping a spring to serve both as the latchplate and the opening for the post.

7 Claims, 7 Drawing Figures

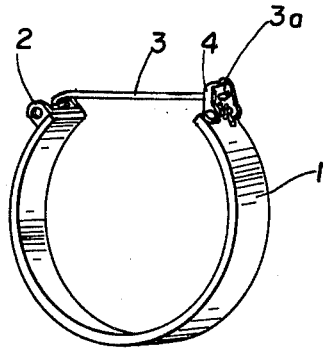
Fig. 1
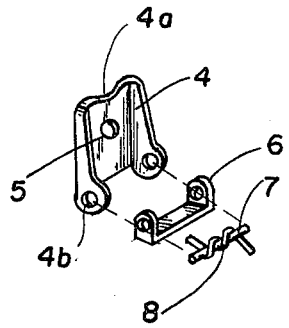
Fig. 2
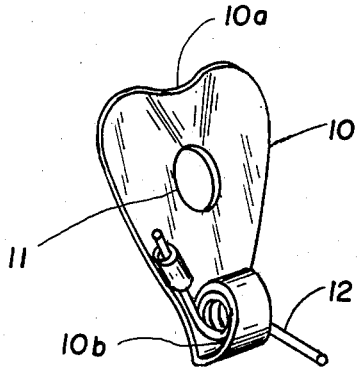
Fig. 3
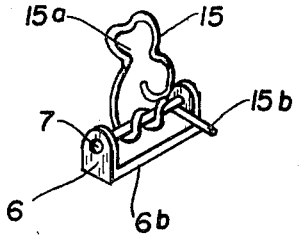
Fig. 5
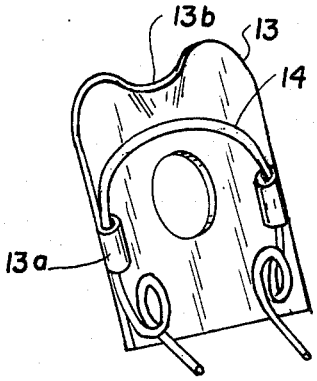
Fig. 4
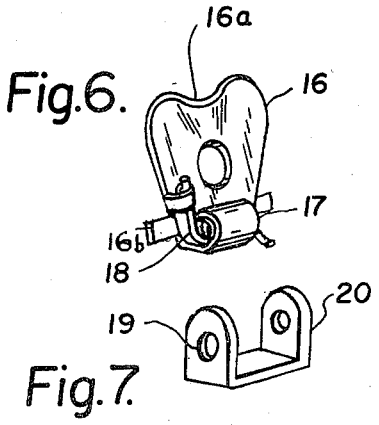
Fig.6.
Fig.7.

EARRING WITH LATCH MEMBER

This invention relates to jewelry and, more particularly, to earring constructions.

An outstanding disadvantage of present constructions for earrings of the type for pierced ears with a straight post and a U shaped retaining clip is that the U shaped clip or retainer tends to become unloosened during wear and the earring is lost. In the case of expensive earrings, this is especially disturbing.

An object of my invention is to overcome the abovementioned disadvantage and to provide a novel earring construction which provides much greater security against loss of the earring during wear.

A more specific object of the invention is to provide a novel lock for the earring, which is easy to apply by mere feel of the wearer and which can be easily and quickly removed.

Other objects and advantages of the invention will become more apparent from the following description taken with the accompanying drawing wherein:

FIG. 1 is a perspective view of an earring embodying the present invention;

FIG. 2 is an enlarged exploded view of the faceplate or latchplate of FIG. 1;

FIG. 3 is an enlarged, perspective view of a modification of the faceplate or latchplate;

FIG. 4 is an enlarged plan view of a further modification;

FIG. 5 is an enlarged, perspective view of a still further modification of the faceplate or latchplate.

FIG. 6 and 7 show another modification of the latchplate and the U-shaped base for pivotally supporting the ears of the latchplate.

Referring more particularly to FIGS. 1 and 2, numeral 1 denotes an earring comprising an arcuate ornamental portion having, at one end, a pivot 2 for pivotal movement of a post 3 having an upwardly bent end portion 3*a* which extends through hole 5 beyond the faceplate or latchplate 4. As will be more clearly apparent from FIG. 2, the faceplate has an upper central bent portion 4*a* to serve as a guide or groove for the end portion 3*a* of the post 3. A U-shaped base 6 with upstanding end flanges having holes supports pin 7 which extends through holes as well as registering holes 4*b* of the faceplate. Spring 8 surrounding pin 7 will yieldingly urge faceplate 4 to the position shown in FIG. 1 since one end of the spring bears against the faceplate and the other end of the spring bears against the outer surface of the arcuate portion.

In operation, assume that the earring is in the locked position shown in FIG. 1 while the post 3 extends through the hole of the ear of the wearer. To remove the earring, the wearer simply, with the index finger, pulls the top portion 4*a* away from the pivotal end of the post 3 so as to withdraw plate 4 clear of end portion 3*a* of the post 3, whereupon the post may be retracted from the pierced ear of the wearer.

When the wearer wishes to mount the earring on the ear, she first inserts the post through the pierced ear while the post is positioned above portion 4*a*. Then by exerting downward pressure on post 3, the end portion of 3*a* will become centered on plate 4 by virtue of the groove formed in bent portion 4*a* and by the camming effect of the upwardly bent portion 3*a*, plate 4*a* is pivoted to the right, as viewed in FIG. 1, against the action of spring 8 so as to tilt it sufficiently for the end of post 3 to ride on the grooved surface of plate 4 until reaching hole 5, at which time the end portion 3*a* will penetrate the hole thereby allowing spring 8 to urge plate 4 to the locking position shown in FIG. 1. It will be noted that such locking can be done very easily and quickly without the necessity of the wearer viewing any part of the earring, but just simply feeling her way to effect such locking.

FIG. 3 shows a modification of the faceplate or latchplate shown in FIGS. 1 and 2. The faceplate 10 may be somewhat heart shaped with an upper central depression 10*a* to form a downwardly tapered groove or guide for the bent end portion 3*a* of the post to hole 11. The bottom end portion of plate 10 is bent upwardly to form a cover for surrounding to return spring 12. An integral tab portion 10*b* of plate 10 surrounds one end of spring 12 while the other end bears against the outer surface of the earring 1.

FIG. 4 shows a further modification of the face plate or latch plate 13 having an upper bent portion 13*b* to form a guide and groove for portion 3*a* of the post. Two upwardly extending tabs 13*a* surround opposite portions of spring 14 while the ends of the spring, after forming a coil, rest against the outer surface of earring 1.

FIG. 5 shows a still further modification having the same mounting as in FIG. 2 except where in the faceplate 4 is eliminated entirely and the spring 15 is bent in such a manner as to take place of both the faceplate and spring. The inwardly bent portion 15*a* provides an upper hole area through which the post 3 may extend. The lower portion of the spring is wrapped around pivot pin 7. One end of the spring 15*b* rests against the outer surface of the earring 1. In some cases, the upper flanges of 6 may be pivotally mounted with respect to the base 6 for the ease of assembly.

FIG. 6 shows a faceplate 16 and groove 16*a* similar to FIG. 4 but having integral ear extensions 16*b* to serve as pivot pin means which extend through holes 19 (FIG. 7) formed in the U-shaped base 20.

Thus it will be seen that I have provided a highly reliable lock for an earring to assure against accidental loss from the ear during wear; furthermore, I have provided an earring construction that is made of relatively few and simple parts which can be easily and quickly manufactured and assembled at very low cost; furthermore I have provided a lock construction which enables locking and unlocking to be done with great ease without the necessity of viewing any of the parts of the earring by the wearer or anyone else; and most of all, I have provided a very firm lock which minimizes the possibility of loss of an earring while it is being worn.

I claim:

1. An earring for pierced ears, said earring comprising an arcuate ornamental portion of less than 360° having ends bridged by a post for piercing the ear, said post pivotally connected to one end of the arcuate portion, a latch member pivotally connected by pin means to the other end of the arcuate portion on the outer periphery thereof, spring means urging said latch member towards said one end of the arcuate portion and a hole formed in said latch member through which the free end of said post is adapted to extend so as to lock said post against pivotal movement and secure said earring on the ear of the wearer.

2. An earring as recited in claim 1 wherein said spring means is a spring helically wound about a pivot mounted on said other end of said arcuate portion.

3. An earring as recited in claim 1 together with a depression in said latch member forming a groove for guiding the end of said post towards said hole.

4. An earring as recited in claim 1 where said latch member is provided with an upstanding ear for anchoring one end of said spring means and having an upturned lower portion for mounting said spring means.

5. An earring as recited in claim 1 wherein said spring means is a spring of inverted U shape and wherein said latch member has two upstanding ears along its sides for encircling the legs of said spring.

6. An earring as recited in claim 1 wherein said latch member and spring means are in the form of a spring which is bent to form said hole and which spring has a lower portion which encircles and spirals aroung a pivot forming the pin means of said pivotal connection of said latch member.

7. An earring as recited in claim 4, said pin means comprising integral ears extending laterally outwardly of said latch member and serving as pivots for pivotal movement of said latch member.

* * * * *